United States Patent [19]

Cox

[11] 4,176,587

[45] * Dec. 4, 1979

[54] VENTILATING DAMPER ASSEMBLY

[75] Inventor: Howard W. Cox, Tempe, Ariz.

[73] Assignee: Mission Marketing Corporation of Arizona, Tempe, Ariz.

[ * ] Notice: The portion of the term of this patent subsequent to Sep. 13, 1994, has been disclaimed.

[21] Appl. No.: 801,082

[22] Filed: May 27, 1977

Related U.S. Application Data

[63] Continuation-in-part of Ser. No. 710,920, Aug. 2, 1976, Pat. No. 4,047,475.

[51] Int. Cl.[2] ..... F04D 25/08; F04D 25/14; F24F 7/00; F24F 13/00

[52] U.S. Cl. ..... 98/116; 98/40 D; 98/86; 98/DIG. 6; 62/314

[58] Field of Search ..... 98/33 R, 33 A, 32, 116, 98/119, DIG. 6, 40 D, 86; 62/314

[56] References Cited

U.S. PATENT DOCUMENTS

| | | | |
|---|---|---|---|
| 2,805,559 | 9/1957 | Hamilton | 62/314 |
| 3,214,936 | 11/1965 | Di Peri | 62/314 |
| 3,521,546 | 7/1970 | Day | 98/32 |
| 3,785,272 | 1/1974 | McNabney et al. | 98/40 D |
| 3,964,268 | 6/1976 | Di Peri | 62/314 |
| 4,047,475 | 9/1977 | Cox | 98/116 |

*Primary Examiner*—Lloyd L. King
*Attorney, Agent, or Firm*—LaValle D. Ptak

[57] ABSTRACT

A ventilating damper assembly particularly adapted for use in conjunction with an evaporative cooler system for architectural structures includes a duct inserted into the ceilings of rooms cooled by the evaporative cooling system to discharge air from within the room through an attic space located above the ceiling and out into the atmosphere through vents in the attic. The ventilating damper assembly has a gravity-closed pivotally-mounted lid on the upper end of the duct to keep the duct closed whenever the evaporative cooling system is not in operation or whenever backdrafts from the attic occur. Positive air pressure within the room moves upwardly through the damper assembly, opening the lid to permit air to escape from the room into the attic, thereby maintaining the air flow necessary for efficient operation of an evaporative cooler and additionally exhausting the relatively cool air into the attic space above the ceiling to further improve the cooling efficiency of the system. Temperature sensitive normally-open self-closing anti-draft dampers close the duct whenever abnormally high temperatures occur.

2 Claims, 9 Drawing Figures

VENTILATING DAMPER ASSEMBLY

RELATED APPLICATIONS

This application is a continuation-in-part of application Ser. No. 710,920, filed Aug. 2, 1976 now U.S. Pat. No. 4,047,475, issued on Sept. 13, 1977.

BACKGROUND OF THE INVENTION

In hot, dry climates such as the desert regions of the Southwestern United States, evaporative cooling systems are widely used for cooling dwellings and other architectural structures. These cooling systems are popular because of their relatively low cost compared with refrigeration cooling or air conditioning systems. Evaporation coolers operate on the principle of the cooling effect provided when water evaporates from a saturated pad through which warm, dry air from outside the dwelling is passed into the dwelling under control of a fan or blower.

For most effective use of an evaporative cooler, it is necessary to exhaust air continuously from the building and to bring fresh air into the building through the evaporation pads of of the cooler. Generally, this is accomplished merely by leaving doors slightly ajar or opening windows in the room which are to be cooled. Because of security reasons and a general reluctance to leave doors and windows open, however, homes or buildings cooled by evaporative coolers often are closed up. This seriously impairs the operating efficiency of the evaporative cooler. Often purchasers of homes which have evaporative coolers in them do not know that it is necessary to have a continuous air flow into and out of the building or home to obtain maximum cooling. This is because this type of operation is in direct contrast to achieving maximum cooling efficiency with refrigeration type air conditioning systems in which it is desirable to have the home or building closed up as tightly as possible.

As a consequence, it is desirable to provide some means for obtaining maximum cooling efficiency from an evaporative cooler with a minimum of effort on behalf of the homeowner or building owner where an evaporative cooler is used. If further is desirable to obtain maximum operating efficiency of evaporative coolers without compromising the security of the dwelling or building in which an evaporative cooler is used. Finally, it is desirable to provide a means for obtaining maximum efficiency from an evaporative cooler which is simple to install and troublefree in operation.

SUMMARY OF THE INVENTION

It is an object of this invention to provide an improved damper assembly.

It is an additional object of this invention to provide an improved ventilating damper assembly including a pressure-actuated damper.

It is another object of this invention to provide an improved ventilating damper assembly having a temperature-responsive anti-draft damper and a pressure actuated damper.

It is a further object of this invention to provide an improved ventilating damper assembly particularly suited for installation in buildings cooled by evaporative coolers.

In accordance with a preferred embodiment of this invention, a ventilating damper assembly includes a ventilating ceiling duct having open upper and lower ends and passing through the ceiling of the room in which the assembly is used. A first normally-closed pressure-opened damper closes the upper end of the duct and opens in response to a positive pressure air flow from within the room through the duct and outwardly into the space above the ceiling of the room in which the duct is used. In addition, a normally-open temperature responsive anti-draft damper is located in the duct to close the duct in response to temperatures above some pre-established temperature, irrespective of the position of operation of the pressure-opened damper.

The ventilating damper assembly is particularly well suited for installation in dwellings or buildings using an evaporative cooler and having an attic space above the ceiling. The air moving through the damper assembly then passes into the attic from which it is vented through the conventional attic vents. This causes the attic temperature to be reduced, thereby reducing the temperature on the ceiling of the dwelling and improving the cooling efficiency of the evaporative cooler.

DETAILED DESCRIPTION

Figure 1:
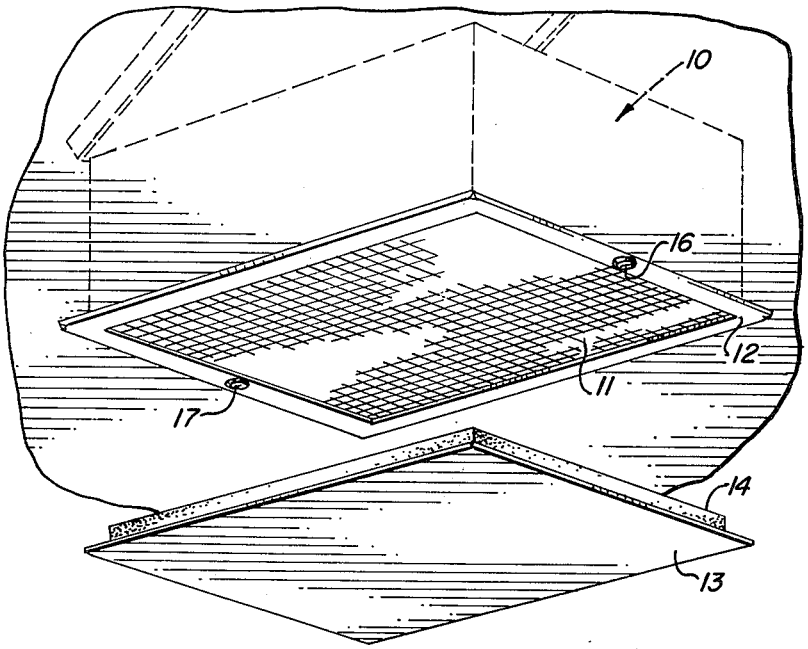
FIG. 1 is a perspective view of the underside of a preferred embodiment of a damper assembly showing its installed appearance.

Referring now to the drawings, the same components are provided with the same reference numerals throughout the several figures. FIG. 1 shows a ventilating damper assembly 10 positioned in the ceiling of a dwelling preferably employing an evaporative cooler which creates a positive air pressure within the room in which the damper assembly 10 is located. From the underside of the damper assembly within the room, the only parts which can be seen are a decorative grill 11 and a decorative molding 12 around the opening into which the assembly 10 is inserted.

Also shown in FIG. 1, in a partially exploded position, is a plate 13 having a layer 14 of foam insulating material bonded to it. The dimensions of the plate 13 and foam layer 14 are such that it can be inserted in place of the decorative grill 11 during the wintertime or other times when no air flow through the damper assembly 10 is desired. This extra plate 13 is often desirable to close off the damper assembly for long periods of time of non-use. The grill 11 then is removed and replaced with the plate 13, and the molding 12 is fastened back in place with the screws 16 and 17.

Figure 2:
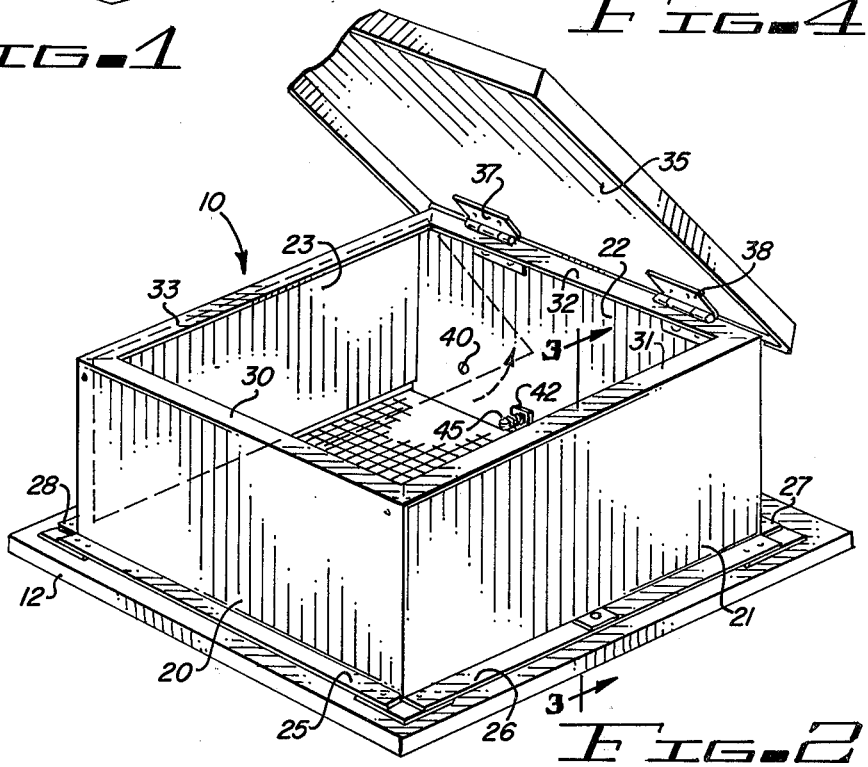
FIG. 2 is a top perspective view of the preferred embodiment of the damper assembly shown in FIG. 1.

FIG. 2 shows in greater detail the damper assembly 10. The assembly 10 is inserted through a suitable rectangular opening cut in the ceiling of a room to communicate with the attic of the building in which the damper assembly is used. The ceiling opening is cut slightly larger than the external dimensions of the duct portion of the assembly 10 formed by four parallel sides 20, 21, 22 and 23. The lower or ceiling edge of each of these sides is terminated in an outwardly flaring flange 25, 26, 27 and 28, respectively; and the upper or attic edges of the sides of the duct portion of the damper terminate in inwardly extending flanges 30, 31, 32 and 33, respectively. The flanges 25 through 28 and 30 through 33 all extend at 90° angles to the planes of the duct sidewalls with which each of these flanges are associated. Preferably the flanges are integrally formed with the duct side members 20 through 23 by conventional sheet metal bending and forming techniques.

The upper or attic end of the ventilating damper assembly 10 is closed by a pivotally-mounted damper lid 35 which is attached by a pair of hinges 37 and 38 to the rear sidewall 22 of the ventilator duct. The hinges 37 and 38 are shown as extending through slots cut in the flange 32 and may be attached to the lid 35 and sidewall 22 in any suitable manner, such as with threaded fasteners, brazing or welding. Alternatively, other forms of hinges other than the hinges 37 and 38 shown in FIG. 2 may be used. It is desired, however, to permit the lid 35 to open easily in response to positive air pressure flow from the room beneath the assembly 10 upwardly through the duct and out into the attic of the building in which the assembly 10 is installed.

The lid 35 normally is closed by gravity and rests on the flanges 30 through 33. To prevent clattering or noisy closure of the lid 35, padding or felt or other material may be placed on the flanges 30 to 33. This also will aid in effectively sealing the duct when the lid 35 is closed. The lid 35 closes in response to backdrafts from the attic into the duct or whenever the evaporative cooling system is turned off, eliminating the positive air pressure within the room in which the ventilating damper assembly 10 is placed.

Preferably the damper assembly 10 is made of aluminum or other suitable lightweight metal. Aluminum is particularly suitable for this application because it is not subject to corrosion, but other materials could be used as well to achieve the same purpose.

If the weight of the lid 35 is not sufficient to give the desired amount of resistance to air flow passing upwardly through the duct, a weight may be placed along the edge opposite the hinges 37 and 38 to cause the lid to be opened at the desired pressure for the particular installation in which the assembly is used. If adjustability of the pressure required to open the pressure-actuated damper lid 35 is desired, and adjustable weight, movably along either the upper or the lower surface of the damper lid 35 in a path perpendicular to the hinged rear edge of the lid, may be used. Then by adjusting the position of the weight along this path an adjustment in the pressure which opens the lid 35 may be made suited to the particular installation in which the damper assembly 10 is used.

Figure 4:
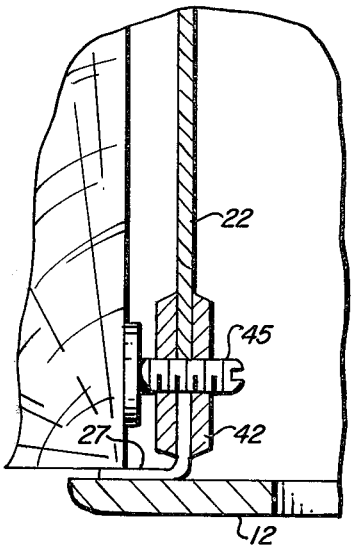
FIG. 4 is a detail of another portion of the assembly shown in FIG. 2.
Figure 3:
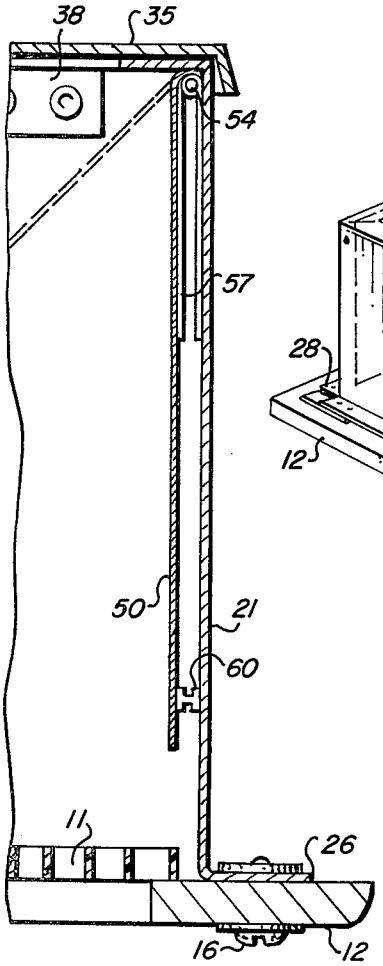
FIG. 3 is a detail of a portion of the assembly shown in FIG. 2; p

To facilitate the installation of the damper assembly 10 into existing structures, the cut in the ceiling preferably is made alongside an existing joist. The rear wall 22 of the damper assembly then is fastened to this joist by means of a suitable fastener, such as the screws 40 and 41 (shown most clearly in FIG. 5). If, however, the joist to which the damper assembly 10 is attached is not perpendicular to the ceiling, it is possible that the opposite wall 20 of the damper assembly could extend downwardly into the room so that the flange 25 is not flush with the ceiling. To permit an adjustment in the tilt or angle of the damper assembly 10 relative to the joist to which it is attached, a flathead screw 45 (shown most clearly in FIG. 4) extends through an opening in the rear wall 22 of the duct of the assembly 10. This screw 45 is threaded into a Tinnerman fastener 42 slipped over the edge of the rear wall 22 through a slot formed in the flange 27. The inside end of the flathead screw 45 is slotted to receive a screwdriver, and the screw 45 may be turned to adjust the angle of the damper assembly 10 relative to the joist to which it is attached to bring the flange 25 into engagement with the underside of the ceiling in the room in which the damper assembly 10 is mounted.

Figure 9:
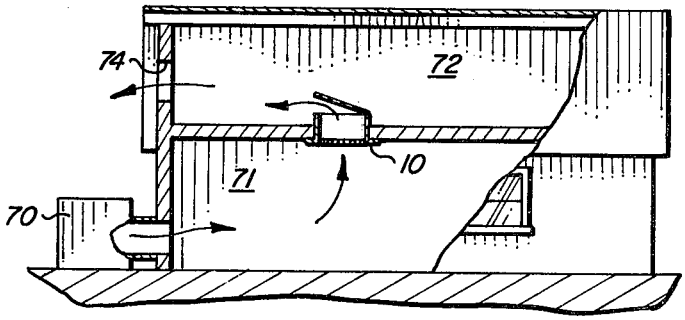
FIG. 9 shows the damper assembly installed in a dwelling using an evaporative cooler.

Reference now should be made to FIG. 9. Whenever an evaporative cooler blower 70 is moving air into the room 71, a positive air pressure differential is built up inside the room 71 relative to the air pressure in the attic 72 above the ceiling in which the damper assembly 10 is placed. This positive air pressure then causes the damper lid 35 to open to permit the air to exit from the room into the attic space 72 above the ceiling. This air in the attic space then moves through the attic outwardly through the conventional attic vents 74 where it is discharged into the atmosphere. This relatively cool moving air passing through the attic of the dwelling substantially lowers the temperature of the air within the attic. This in turn lowers the temperature of the ceiling of the dwelling. The necessary positive air flow from outside of the dwelling through the cooler, through the dwelling, and back outside is continuously maintained. By passing the cooled air out of the room 71 through the attic 72 to lower the temperature on the ceiling of the room, the evaporative cooler 70 is able to maintain lower temperatures in the room than is possible with evaporative cooler systems operated in a conventional fashion without ceiling-attic ducts 35 of the type here described.

An additional feature is built into the duct assembly 10 and is shown in greater detail in FIGS. 3, 5, 6, 7 and 8. Along each of the opposite sidewalls 21 and 23 is an auxiliary anti-draft damper 50 and 51, respectively. Each of the anti-draft dampers 50 and 51 is pivotally mounted along the upper edge just beneath the corresponding flange 31 or 33 by pivot pins 54 and 55, respectively, passing through the front and back sidewalls 20 and 22 of the damper assembly 10. The pins 54 and 55 extend through rolled over edges of the dampers 50 and 51 and, after insertion through the sidewalls 20 and 22, may be bent over or flattened to prevent their removal from the damper assembly 10.

Figure 5:
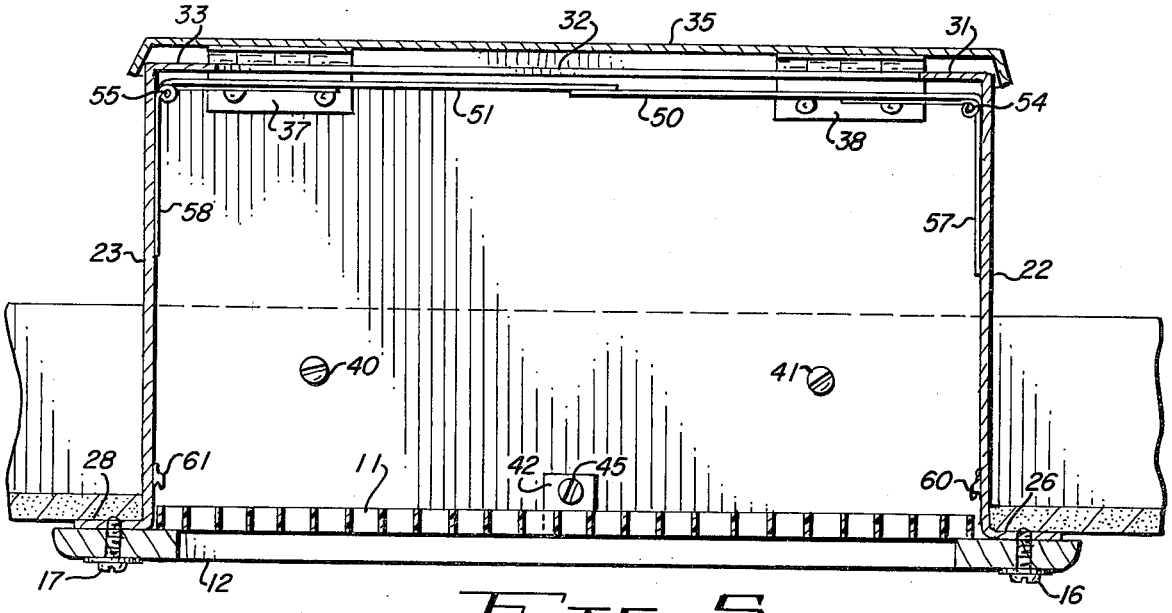
FIG. 5 is a cross-sectional view of the assembly shown in FIG. 2.
Figure 6:
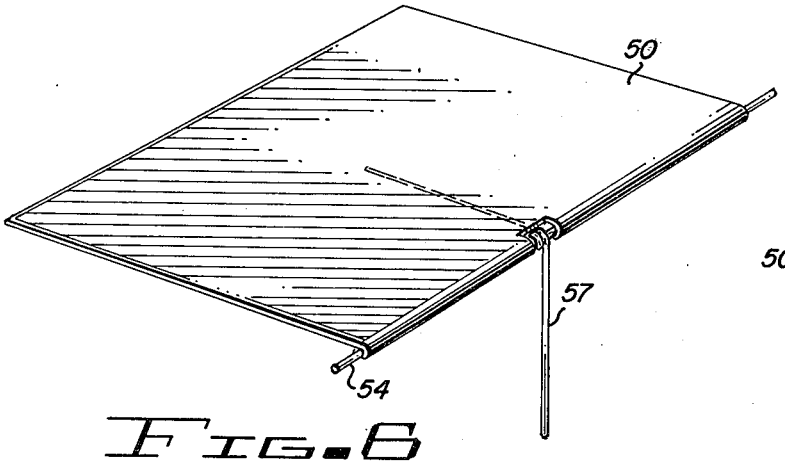
FIGS. 6 and 7 show details of a portion of the assembly in FIG. 5.
Figure 7:
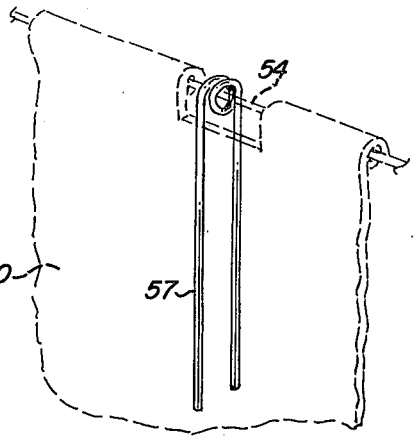

Both of the anti-draft dampers 50 and 51 are springbiased by respective biasing springs 57 and 58 to a closed position across the upper end of the opening of the duct formed by the sidewalls 20 through 23. The dampers 50 and 51 are spring-biased by respective biasing springs 57 and 58 to a closed position across the upper end of the opening of the duct formed by the sidewalls 20 through 23. The dampers 50 and 51 press against the underside of the flanges 30 through 33 to effectively seal off the opening through the duct whenever the dampers 50 and 51 are closed. The width of the dampers 50 and 51 is selected to cause them to overlie the flanges 30 and 32 on opposite sides of the duct, and the length of each of the dampers 50 and 51 is slightly greater than half the distance between the sidewalls 21 and 23. Thus, in their closed position, the anti-draft dampers 50 and 51 overlap one another, as shown most clearly in FIG. 5. FIGS. 6 and 7 illustrate the structural details of the anti-draft damper 50, pivot rod 54 and spring 57. The spring 57 is shown in its extended position in FIGS. 5 and 6 and is shown in its stressed position in FIG. 7. A similar assembly is used on the opposite side for the damper 51.

Figure 8:
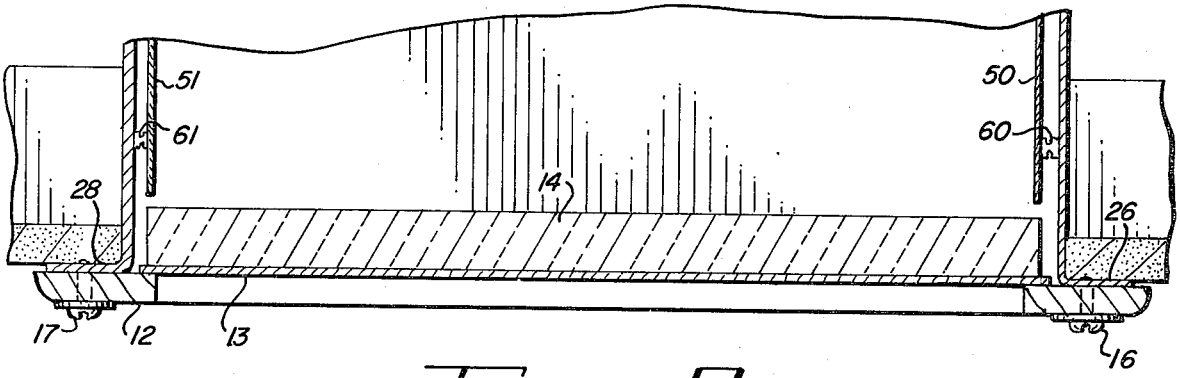
FIG. 8 is a partially cut away view of the assembly of FIG. 5 illustrating an auxiliary feature.

During normal operation of the damper assembly 10, the anti-draft dampers 50 and 51 are held against the sidewalls 22 and 23, respectively, (FIG. 8). These links may be formed of any suitable heat sensitive material having a preestablished melting point which is above the ambient temperatures normally encountered in structures in which the damper assembly 10 is used. Links of this type are commonly available and are made of low melting point metals or plastics and respond to excessive temperature reached for example, when an overheating condition such as might be caused by a fire exists in the immediate locality of the links.

When the ambient temperature in the region of the links 60 and 61 rises above the melting point of the links, they melt and permit the anti-draft dampers 50 and 51 snap closed under the action of the biasing springs 57 and 58. In FIG. 5, as stated previously, the dampers 50 and 51 are shown in the closed position following the melting of the respective fusible links 60 and 61.

Since the anti-draft dampers 50 and 51 each extend more than half way across the space between the walls 22 and 23, it may be advisable to cause the links 60 and 61 to have slightly different melting points; so that one of the anti-draft dampers 50 or 51 closes before the other. This would prevent the possibility, even though remote, of the dampers 50 and 51 binding together without fully closing the ducts as illustrated in FIG. 5. With different melting temperatures of the two links 60 and 61, an overlap of the dampers 50 and 51 in the closed position as shown in FIG. 5 will always occur.

Under normal conditions of operation of the ventilating damper assembly 10, the anti-draft dampers 50 and 51 never are closed. During times of emergency, however, such as occur when a fire exists in a room of the building, it is important to positively close off the duct with the dampers 50 and 51 irrespective of the condition of operation of the lid 35 to prevent heated air from rising upwardly through the duct into the attic of the dwelling in which the assembly 10 is used.

FIG. 5 shows the manner in which the grate 11 is held in place by the molding 12 and also shows the details of the manner in which the screws 16 and 17 connect the molding 12 to the lower flanges 26 and 28, respectively. In addition, FIG. 8 shows the plate 13 and insulating block 14 held in place by the molding 12 for the purpose described previously in conjunction with FIG. 1.

The damper assembly 10 is an effective low-cost device for substantially improving the operating efficiency of an evaporative cooling system.

I claim:

1. In a building of the type cooled by an evaporative cooling system, having an enclosed living space with a ceiling an enclosed attic above the ceiling, a vent establishing communication between the attic and the atmosphere outside the building, and an evaporative cooling means for continuously drawing air from outside the building through such cooling means and discharging such air into said living space, an improvement comprising a normally closed pressure-actuated ventilating damper assembly located in the ceiling between said living space and said attic and adapted to open in response to greater air pressure within the living space than in the attic to discharge air from the living space through said vent and the attic to the outside of the building whenever air is discharged into the building through said evaporative cooling means.

2. The combination according to claim 1 further including temperature-responsive anti-draft damper means for closing and maintaining closed said damper assembly in response to temperatures above a predetermined temperature irrespective of variations in air pressure between said living space and said attic.

* * * * *